US007717972B2

(12) United States Patent
Huang et al.

(10) Patent No.: US 7,717,972 B2
(45) Date of Patent: May 18, 2010

(54) DIAMOND DISC MANUFACTURING PROCESS

(75) Inventors: Wei Huang, Bade (TW); Cheng-Hsiang Chou, Taipei (TW); Chih-Chung Chou, Taipei (TW)

(73) Assignee: Kinik Company, Taipei (TW)

( * ) Notice: Subject to any disclaimer, the term of this patent is extended or adjusted under 35 U.S.C. 154(b) by 209 days.

(21) Appl. No.: 11/828,231

(22) Filed: Jul. 25, 2007

(65) Prior Publication Data

US 2008/0022603 A1 Jan. 31, 2008

(30) Foreign Application Priority Data

Jul. 26, 2006 (TW) ..... 95127398 A

(51) Int. Cl.

| | |
|---|---|
| ***B24B 1/00*** | (2006.01) |
| ***B24D 11/00*** | (2006.01) |
| ***B24D 3/02*** | (2006.01) |
| ***C09C 1/68*** | (2006.01) |
| ***C09K 3/14*** | (2006.01) |
| ***B21K 5/20*** | (2006.01) |

(52) U.S. Cl. ..... 51/295; 51/307; 76/107.1

(58) Field of Classification Search ..... 51/295, 51/307; 76/107.1

See application file for complete search history.

(56) References Cited

U.S. PATENT DOCUMENTS

| | | | | |
|---|---|---|---|---|
| 3,906,684 | A * | 9/1975 | Marshall et al. | 51/295 |
| 5,092,910 | A | 3/1992 | deKok et al. | |
| 5,273,558 | A * | 12/1993 | Nelson et al. | 51/298 |
| 5,342,419 | A * | 8/1994 | Hibbard | 51/308 |
| 5,380,390 | A * | 1/1995 | Tselesin | 156/230 |
| 5,695,533 | A * | 12/1997 | Kardys et al. | 51/295 |
| 2001/0025457 | A1 * | 10/2001 | Tselesin | 51/293 |
| 2003/0084894 | A1 * | 5/2003 | Sung | 125/12 |
| 2004/0107649 | A1 * | 6/2004 | Emerson et al. | 51/295 |

FOREIGN PATENT DOCUMENTS

| | | |
|---|---|---|
| JP | 11-077536 | 3/1999 |
| JP | 2001-138245 | 5/2001 |
| TW | 412461 | 11/2000 |
| TW | 541226 | 7/2003 |
| WO | 1990/009260 | 8/1990 |

* cited by examiner

*Primary Examiner*—Anthony J Green
*Assistant Examiner*—Pegah Parvini
(74) *Attorney, Agent, or Firm*—Workman Nydegger

(57) ABSTRACT

A diamond disc manufacturing process includes the following steps. Firstly, a container is provided, and an adhesion layer is formed in the container. A hollow member having a plurality of meshes is covered on the adhesion layer. A plurality of diamond particles is implanted on the hollow member and embedded into the meshes of the hollow member, so that the diamond particles are adhered onto the adhesion layer. Then, a resin material is infused into the container, so that the diamond particles are bonded on the resin material. Finally, the resin material together with the diamond particles is released from the container, so as to obtain a diamond disc base with the diamond particles having uniform distribution and orientation.

8 Claims, 8 Drawing Sheets

DIAMOND DISC MANUFACTURING PROCESS

CROSS-REFERENCE TO RELATED APPLICATIONS

This non-provisional application claims priority under 35 U.S.C. §119(a) on Patent Application No(s). 095127398 filed in Taiwan, R.O.C. on Jul. 26, 2006, the entire contents of which are hereby incorporated by reference.

BACKGROUND OF THE INVENTION

1. Field of Invention

The present invention relates to a diamond disc manufacturing process, and more particularly to a diamond disc manufacturing process which can provide uniform distribution and orientation of diamond particles.

2. Related Art

In recent years, since the technology of integrated circuits (IC) is developed rapidly and becomes mature, the semiconductor industry becomes one of the vigorously developed industries. Semiconductor products may be widely used in information, communication, consumer electronics, industrial instruments, transportation, defense and space, and other fields, and have great impacts on electronic products. Therefore, the semiconductor products certainly are of great importance.

Silicon wafer is a quite important material in the semiconductor industry. The silicon wafer must be subject to a chemical mechanical polishing (CMP) process. Firstly, planarzing the wafer surface, so that subsequent processes for manufacturing chip may be performed thereon, thereby enhancing the accuracy and yield of the process. The efficiency of a polishing pad used in the CMP process for a long time will be gradually reduced since abrasive particles may be filled in the clearance of the polishing pad. Thus, the polishing pad must be conditioned regularly to remove residual impurities and polishing remains, so as to maintain an optimal polishing state. Therefore, the semiconductor industry applies the diamond to a diamond disc (pad conditioner) for cleaning the polishing pad. The diamond disc (pad conditioner) is disc-shaped or ring-shaped and is also referred to as a diamond disc (pad conditioner).

The method of manufacturing a diamond disc in the prior art includes forming a metal bonding layer by a electroplating or sintering process, so as to wrap diamond particles and stick them on a surface of a metal substrate. However, the two conventional methods of manufacturing a diamond disc cannot provide a sufficient bonding power to stick the diamond particles on the surface of the metal substrate closely. Thus, the diamond particles may drop off from the diamond disc (pad conditioner) due to the insufficient bonding power. In a CMP process, the dropped diamond particles easily scratch the expensive silicon wafer, leading to the damage to the surface of the silicon wafer. In order to solve the problem that the diamond particles easily dropping off, a brazing process must be added, but that will cause an increase of the manufacturing processes and cost.

In addition, in order to extend the lifetime of the diamond disc (pad conditioner) and improve the polishing characteristics. Taiwan Patent No. 412461 and U.S. Pat. No. 5,092,910 disclose a die hole or a screen with regularly distributed holes is used to make the diamond particles arranged on an abrasive tool in a pattern regularly and a manufacturing method thereof, which replaces the manner of arranging the diamond particles randomly and irregularly on the conventional polishing tool. Furthermore, Taiwan Patent No. 541226 discloses a method of uniformly arranging diamond particles to have the same height. The method arranges the polishing particles on a positioning trench on a carrier with an appropriate interval, and fills the bonding agent in the positioning trench to achieve the uniform orientation of the polishing particles.

Although Taiwan Patent No. 412461 and U.S. Pat. No. 5,092,910 may achieve the purpose of uniformly arranging the diamond particles with an appropriate interval. However, since the meshes of the adopted die hole or the screen have a size larger than that of the diamond particles, the diamond particles just only arranged regularly according to the positions of the meshes, but the orientation of each of the diamond particles in the arrangement position cannot be controlled, resulting in that the diamonds on the diamond disc (pad conditioner) have different heights, which negatively influences the polishing uniformity and lifetime of the diamond disc (pad conditioner). Furthermore, after the diamond particles stick and are arranged on the surface of the wafer, a brazing process is still reburied to be closely bond the diamond particles with the surface of the wafer, thereby causing the problems, such as deformation of the substrate and deterioration of the diamond particles.

In Taiwan Patent No. 541226, the carrier for arranging the diamond particles must be milled firstly into a positioning trench with a predetermined shape, which results in the increase of the manufacturing cost due to the additional processing procedure of the carrier. Furthermore, in order to make the diamond particles have uniform orientation, it is required to spend more manufacturing time on the procedure of placing the diamond particles, thus reducing the efficiency of manufacturing the diamond disc (pad conditioner).

In the conventional method of manufacturing the diamond disc (pad conditioner) although the plurality of diamond particles may be arranged regularly and uniformly, the diamond particles cannot have uniform orientation, or more manufacturing cost and time must be spent to achieve the purpose of arranging the polishing particles in uniform orientation.

SUMMARY OF THE INVENTION

In view of the above problems, the object of the invention is provide a diamond disc manufacturing process, so as to solve the limitations or defects in the prior art that the diamond particles are distributed non-uniformly, in random orientation, and at different heights, and the complicated processes and the high cost.

In the diamond disc manufacturing process according to the present invention, firstly, a container is provided. An adhesion layer is formed in the container. Then, a hollow member having a plurality of meshes is covered on the adhesion layer. A plurality of diamond particles are implanted and embedded in the meshes of the hollow member, so that the diamond particles are adhered onto the adhesion layer. Subsequently, a resin material is infused in the container, so as to bond the diamond particles on the resin material. Finally, the resin material together with the diamond particles is released from the container to obtain a diamond disc base with the diamond particles having uniform distribution and orientation.

The advantage of the present invention lies that, the size of the meshes of the hollow member is slightly smaller than the size of the diamond particles, so the diamond particles are forced to be embedded into the meshes of the hollow member with the acute corners, so that the plurality of diamond particles have uniform distribution and orientation, thereby achieving the optimal polishing effect. Moreover, a sufficient fixation force may be provided for the diamond particles only by the resin material without using the brazing process, thereby simplifying the steps of the diamond disc manufacturing process and reducing the manufacturing cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

Figure 1A:
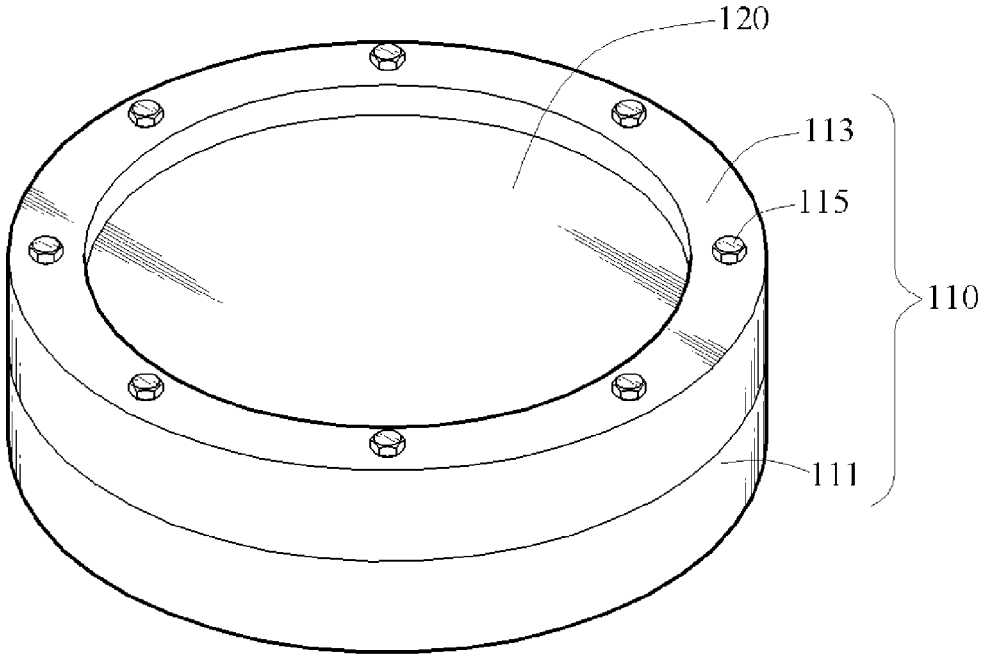
FIG. 1A is a schematic perspective view of separate steps of the present invention.
Figure 1B:
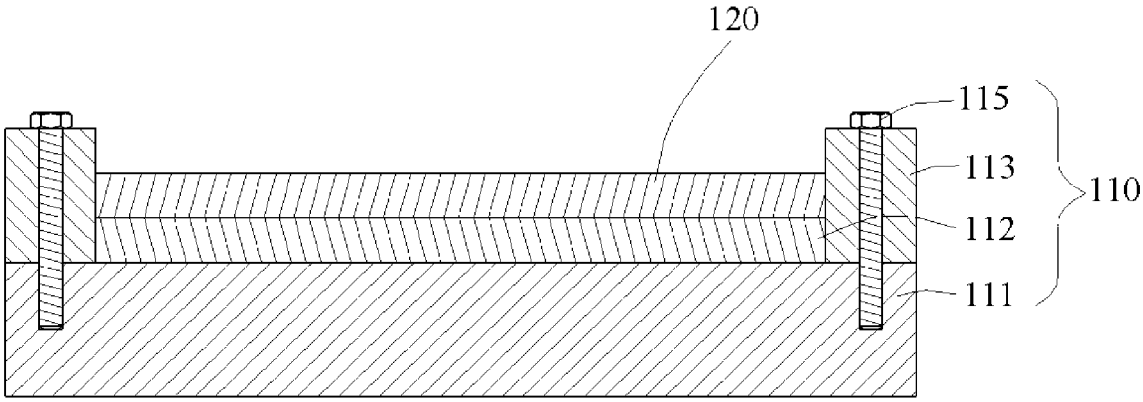
FIG. 1B is a schematic cross-sectional view of separate steps of the present invention.

Referring to FIGS. 1A-6B, the steps of the diamond disc manufacturing process of the present invention are shown. As shown in FIGS. 1A and 1B, a container 110 is provided as an operating platform for manufacturing the diamond disc (pad conditioner), and an adhesion layer 120 is formed on a pan 112 of a container 110. The adhesion layer 120 is formed by placing an adhesion material on the pan 112, and rolling the adhesion material to be 0.3 mm thick, so as to facilitate the subsequent operation of the diamond disc manufacturing process. The adhesion material is a clay materials having adhesiveness.

Figure 2A:
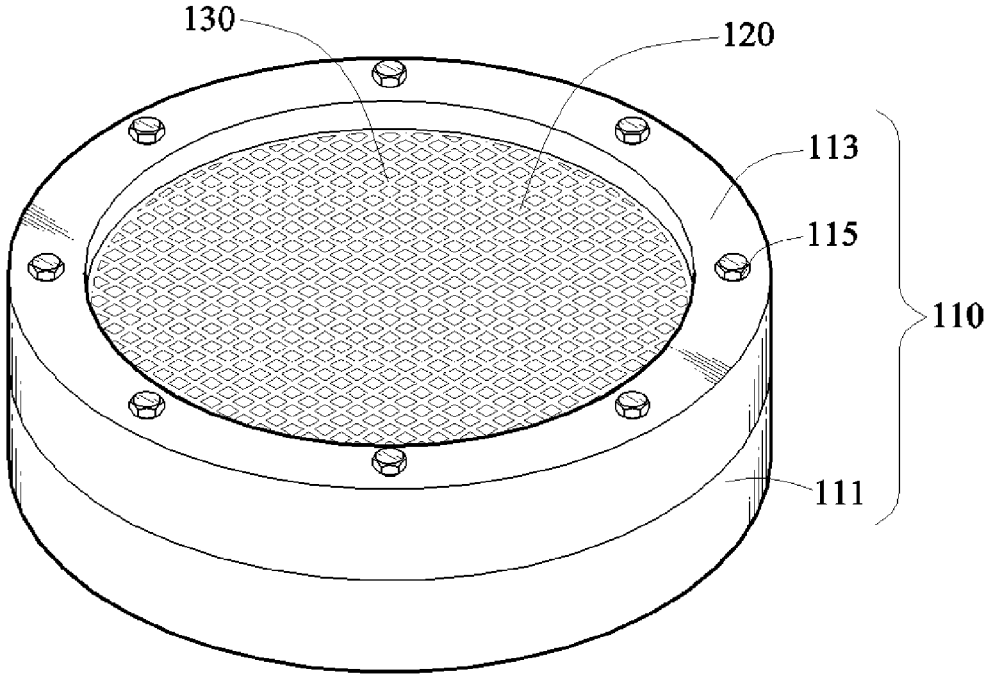
FIG. 2A is a schematic perspective view of the separate steps of the present invention.
Figure 2B:
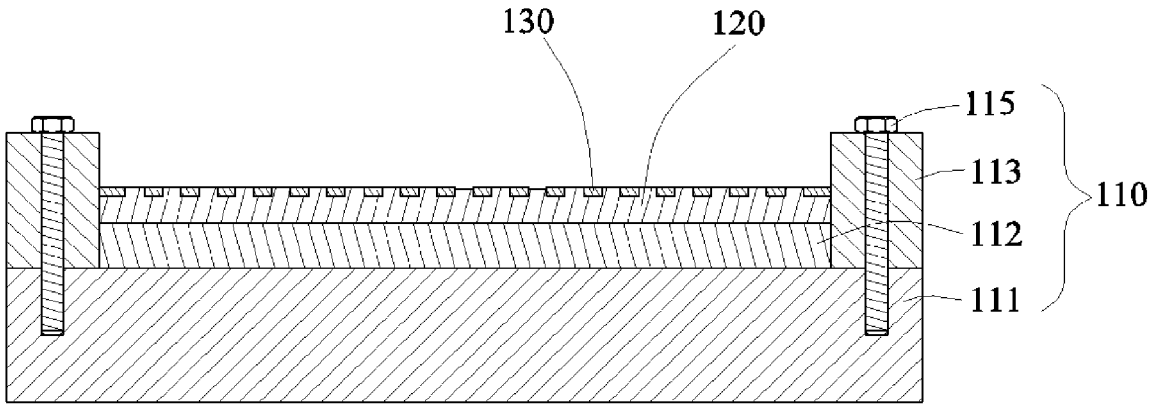
FIG. 2B is a schematic cross-sectional view of separate steps of the present invention.

As shown in FIGS. 2A and 2B, a hollow member 130 having a plurality of meshes is covered on the adhesion layer 120 which has been rolled. The hollow member 130 is a nylon mesh, and the size of the meshes is in a range of 190 μm-220 μm. The hollow member 130 is pressed into the adhesion layer 120 by half of the thickness, so that the adhesion layer 120 is filled in the partial space of the meshes of the hollow member 130.

Figure 3:
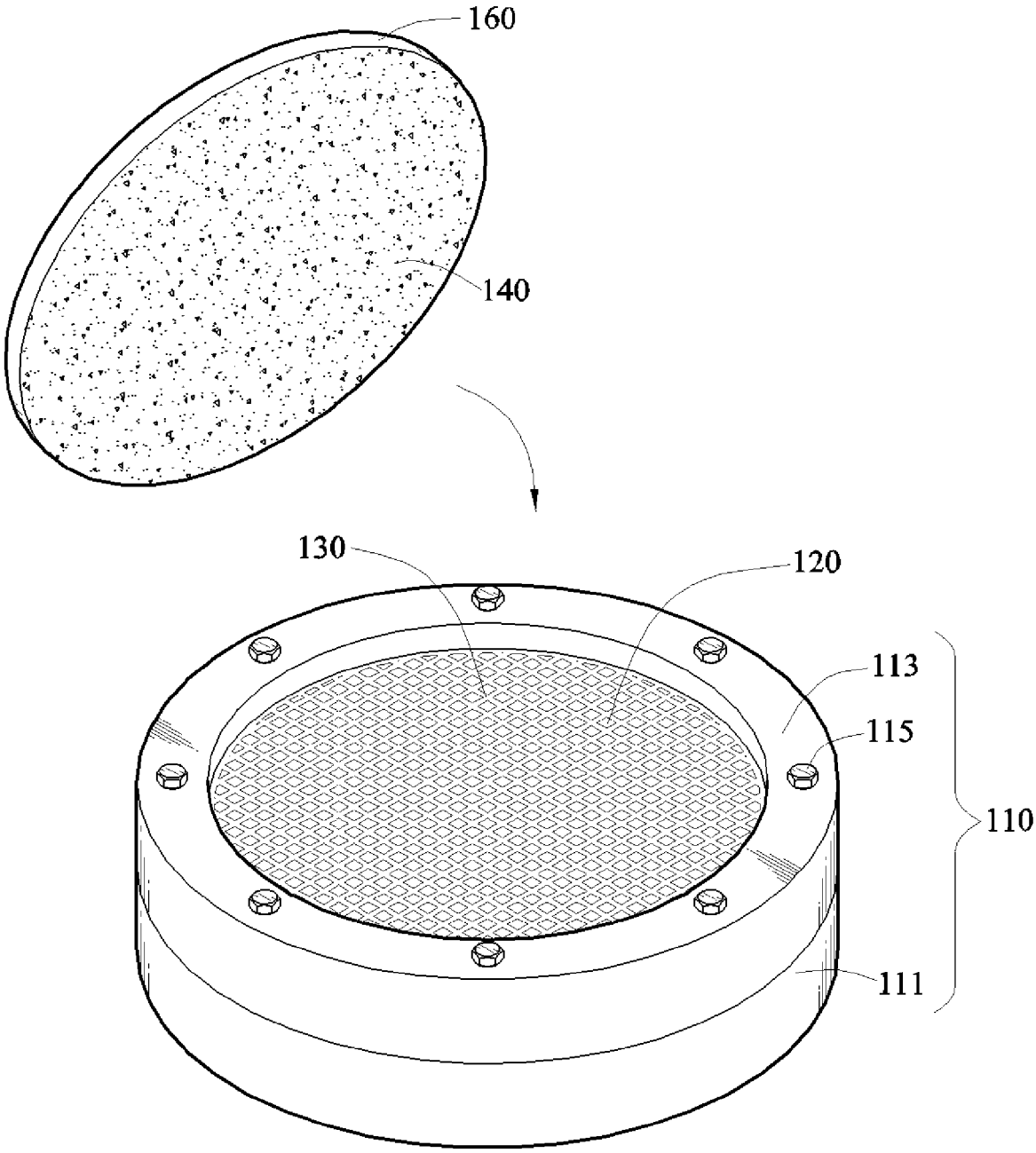
FIG. 3 is a schematic perspective view of separate steps of the present invention.
Figure 4A:
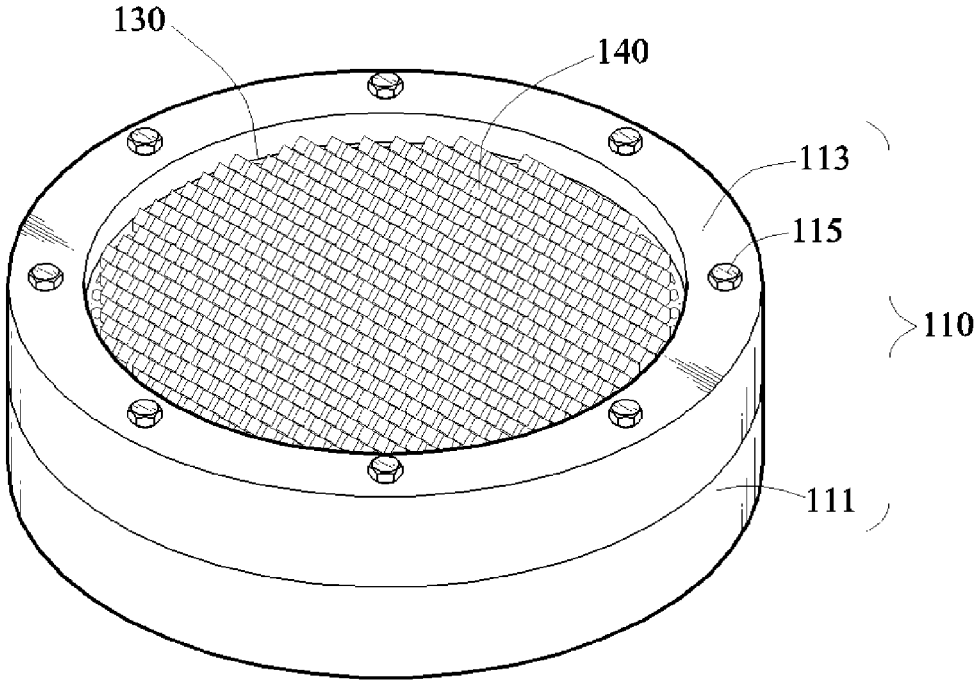
FIG. 4A is a schematic perspective view of separate steps of the present invention.
Figure 4B:
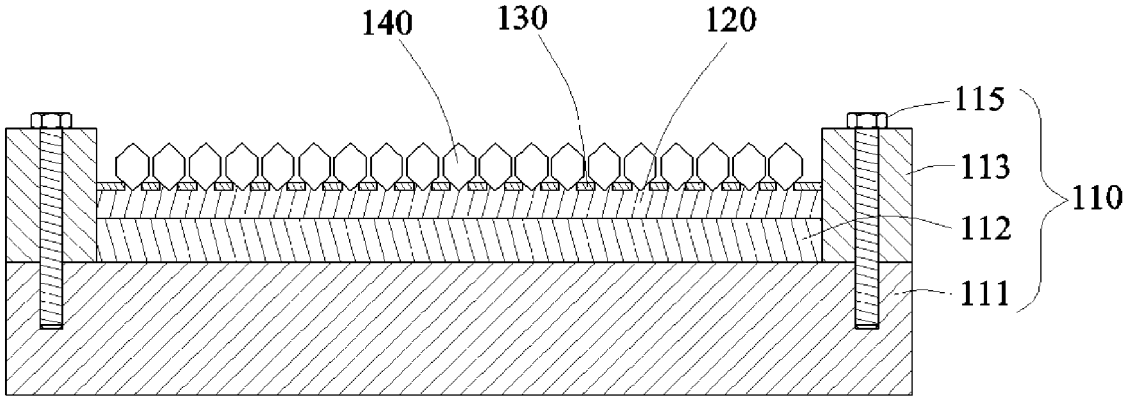
FIG. 4B is a schematic cross-sectional view of separate steps of the present invention.

As shown in FIG. 3, FIG. 4A, and FIG. 4B, a plurality of diamond particles 140 is adhered onto a low adhesive tape 160, and stick onto the hollow member 130 by the adhesive tape 160, thereby transferring and implanting the plurality of diamond particles 140 on the hollow member 130. Then, an appropriate pressure is exerted to embed the plurality of diamond particles 140 into the meshes of the hollow member 130, so as to be adhered onto the adhesion layer 120. The grain diameter of the diamond particles 140 adhered onto the adhesion layer 120 is in a range of mesh 60-mesh 50 (about 250 μm-300 μm), i.e., the grain diameter of the diamond particles 140 is slightly larger than that of the meshes of the hollow member 130. Therefore, when a pressure is exerted to implant the diamond particles 140 on the hollow member 130, the diamond particles 140 are forced to be embedded into the meshes of the hollow member 130 with the acute corners, and are adhered onto the adhesion layer 120 that is filled in the meshes, so that the diamond particles 140 are uniformly distributed on the adhesion layer 120 and have the uniform orientation.

Figure 5A:
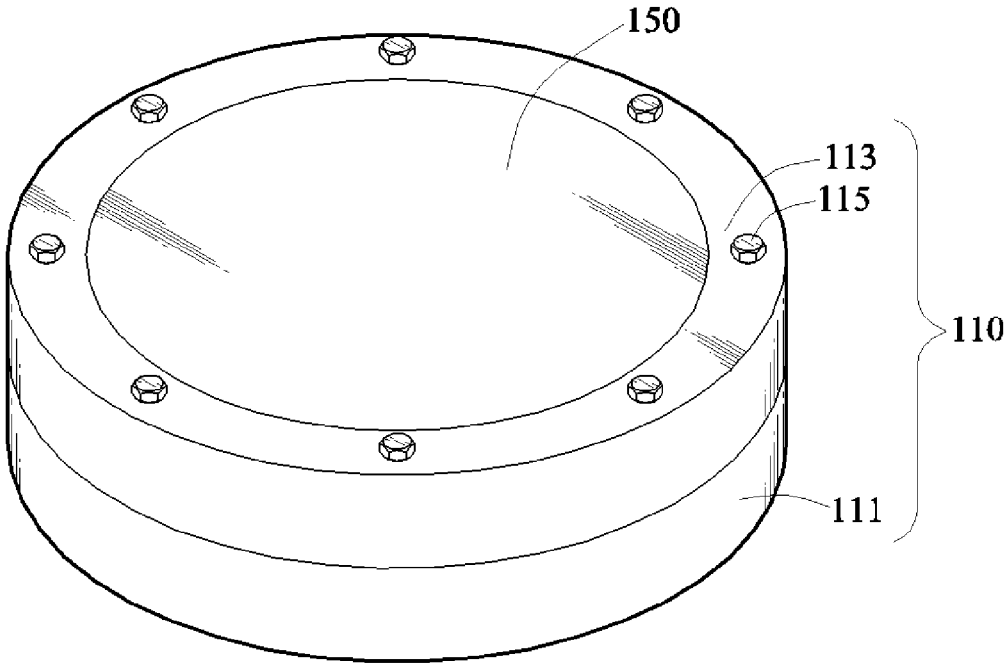
FIG. 5A is a schematic perspective view of separate steps of the present invention.
Figure 5B:
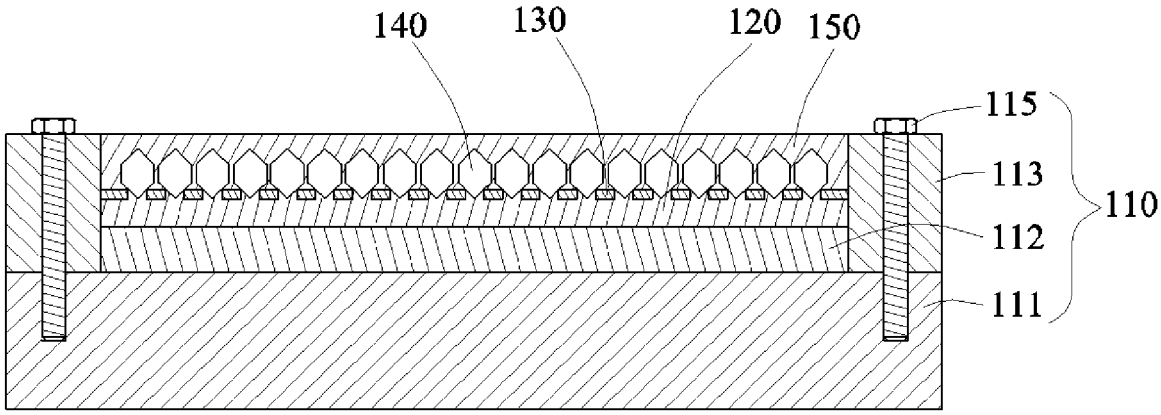
FIG. 5B is a schematic cross-sectional view of separate steps of the present invention.

As shown in FIGS. 5A and 5B, a resin material 150 is infused into the container 110, so as to cover the diamond particles 140 having uniform distribution and orientation. The resin material 150 uses the epoxy resin as a bonding agent for the diamond particles 140, so as to avoid the problems such as the deformation of a substrate and the deterioration of the diamond particles caused by the high temperature brazing process existing in the prior art.

Figure 6A:
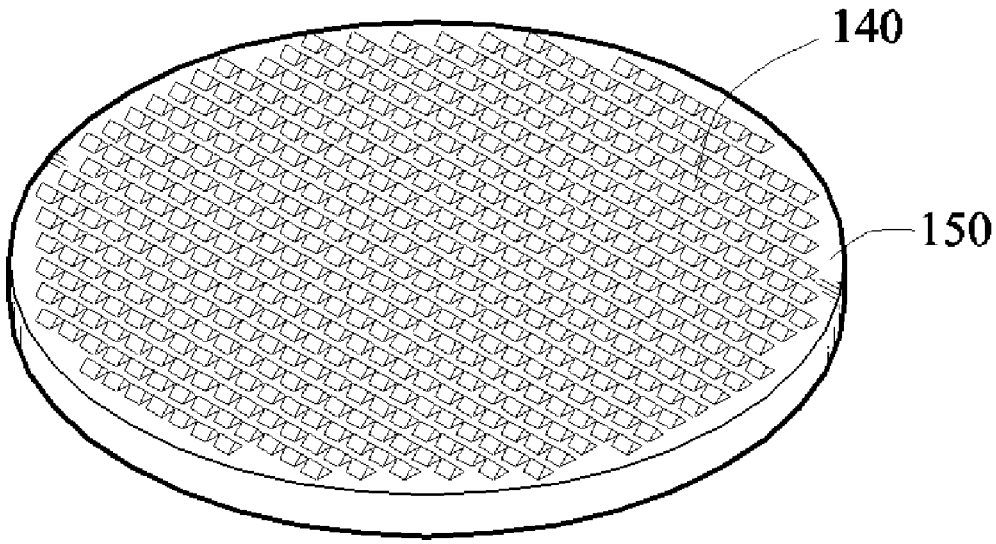
FIG. 6A is a schematic perspective view of separate steps of the present invention.
Figure 6B:
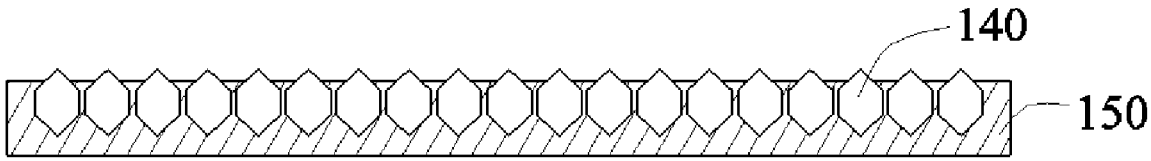
FIG. 6B is a schematic cross-sectional view of separate steps of the present invention.

As shown in FIGS. 6A and 6B, after a self-hardening or a curing process, the resin material 150 bonds the diamond particles 140 on the resin material 150 tightly. Thus, the resin material 150 together with the diamond particles 140 may be released from the container 110, so as to form a disc-shaped resin material 150 of the diamond particles 140 having uniform distribution and orientation. It should be noted that, according to the predetermined positions of the meshes of the hollow member 130 of the present invention, the diamond particles 140 are arranged on the diamond disc (pad conditioner) to form a corresponding arrangement pattern according to the arrangement positions of the meshes. However, those skilled in the art may design a hollow member 130 having a different mesh pattern and size according to actual requirements, so that the diamond particles 140 have a corresponding arrangement pattern, which is not limited to the arrangement pattern disclosed in the present invention.

Figure 7A:
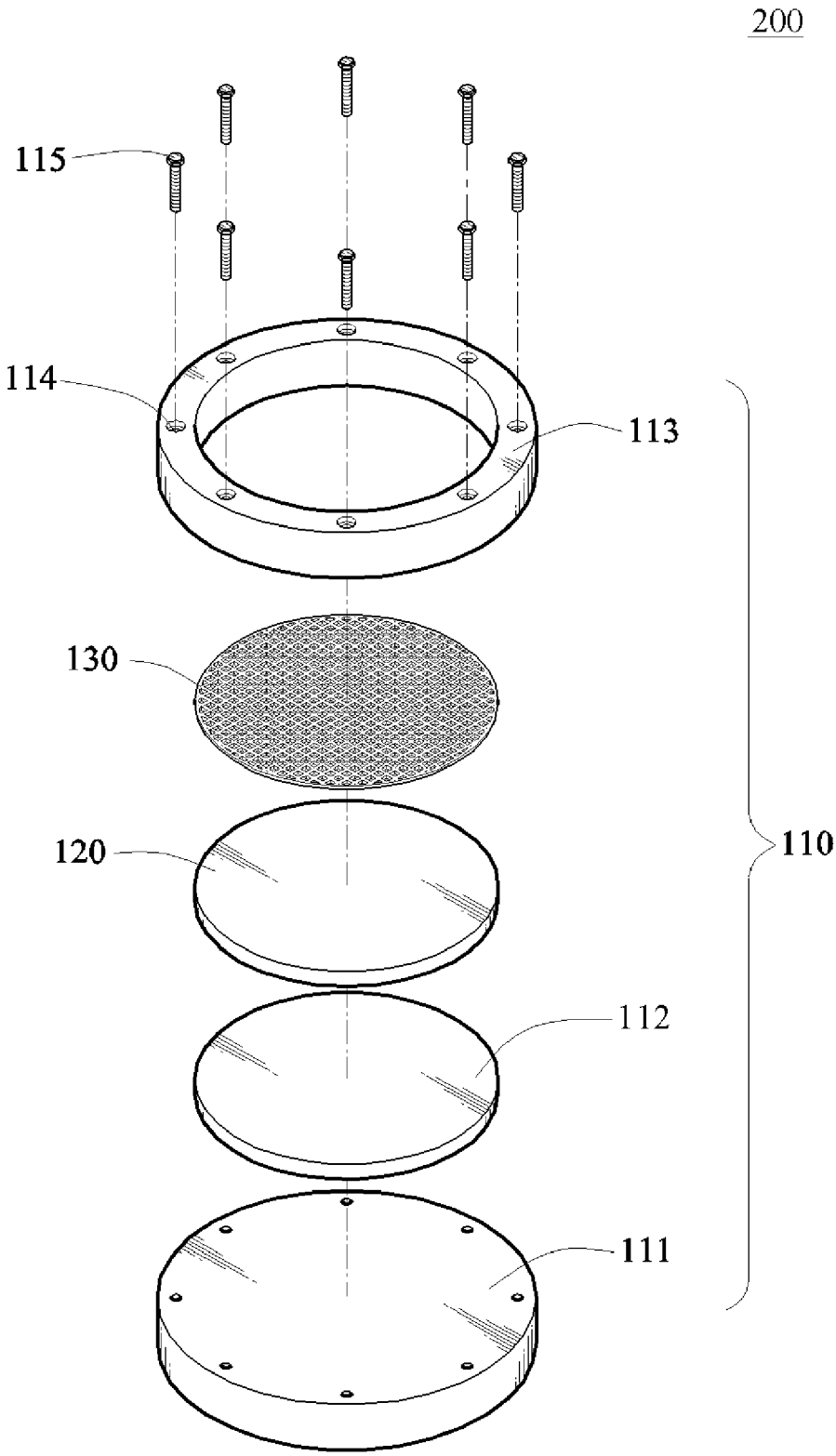
FIG. 7A is a schematic perspective view of a manufacturing die of the present invention.
Figure 7B:
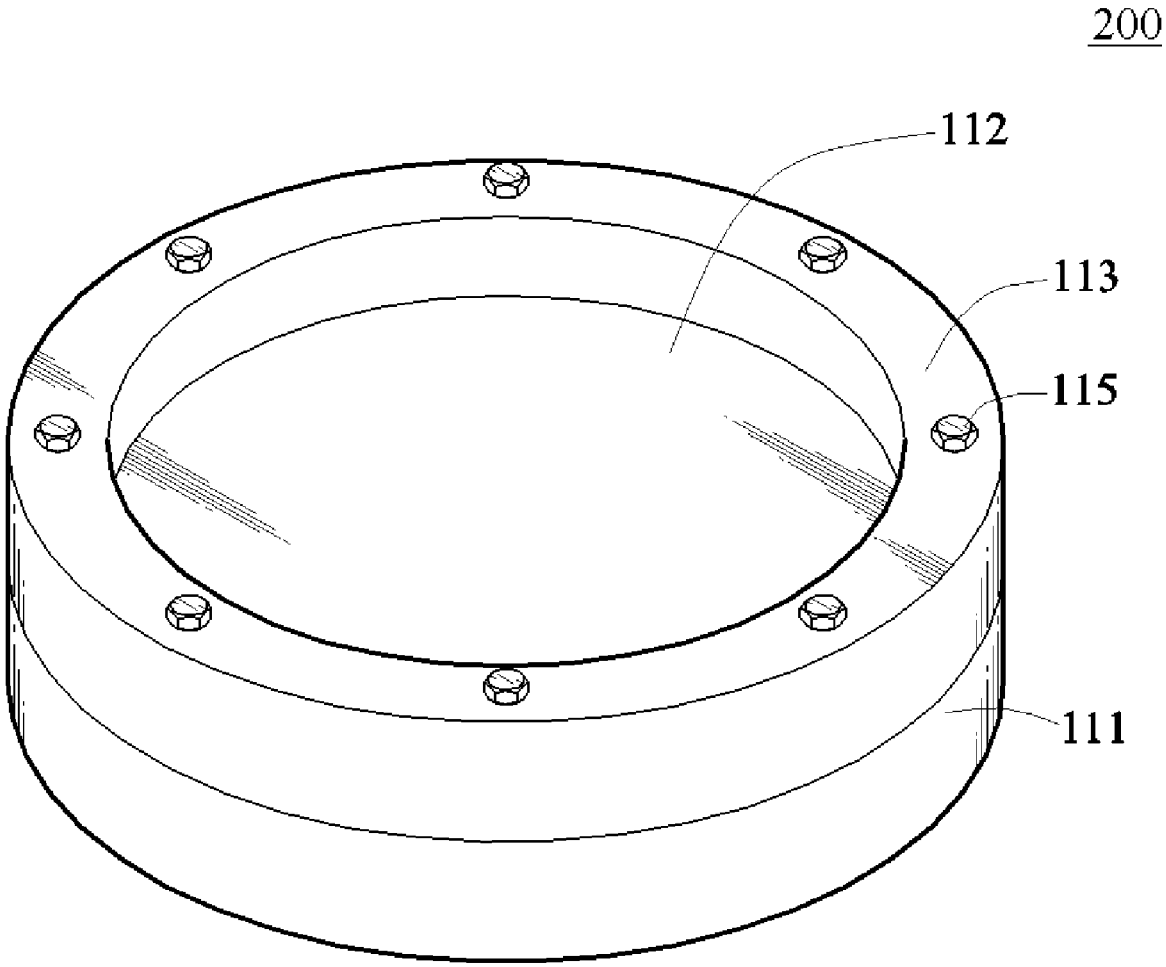
FIG. 7B is a schematic perspective view of a container of the present invention.

FIGS. 7A and 7B show a manufacturing die 200 for manufacturing the diamond disc of the present invention. As shown in FIG. 7A, the manufacturing die 200 includes a container 110, an adhesion layer 120, and a hollow member 130, and the container 110 provides a space for manufacturing the diamond disc. The adhesion layer 120 is disposed in the container 110 for the plurality of diamond particles 140 to be adhered thereon, and the hollow member 130 is covered on and pressed in the adhesion layer 120, so that the diamond particles 140 are embedded into the meshes of the hollow member 130.

As shown in FIGS. 7A and 7B, the container 110 further includes a first external mold 111, a pan 112, and a second external mold 113. The first external mold 111 is used as a base (bottom) of the container 110, and the pan 112 is disposed on the first external mold 111, so as to provide an area for manufacturing the diamond disc. The second external mold 113 is a hollow structure which has a size corresponding to that of the pan 112, so as to be embedded with the first external mold 111 and the pan 112, thereby forming an accommodation space. Furthermore, outer edges of the first external mold 111 and the second external mold 112 respective have a plurality of corresponding combination holes 114. A corresponding number of fixing units 115, such as screws and other locking parts, pass through the combination holes 114 to combine the first external mold 111 and the second external mold 113 tightly, so as to avoid the manufactured diamond disc releasing from the two external molds 111 and 113 in the diamond disc manufacturing process which may result in poor quality.

Compared with the conventional art, the diamond disc manufacturing process of the present invention forces the diamond particles with a larger size to be embedded into the meshes with a smaller size with the acute corners according to the positions of the meshes of the hollow member, so as to achieve the uniform distribution and orientation of the diamond particles. Therefore, the diamond particles will not drop off easily, the polishing and cutting property of the diamond disc (pad conditioner) is enhanced, and the lifetime of the diamond disc (pad conditioner) is extended.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A diamond disc manufacturing process, comprising:

providing a molding container;

forming an adhesion layer in the molding container;

providing a hollow member having a plurality of meshes of a predetermined size on the adhesion layer;

providing a plurality of diamond particles into each mesh of the hollow member, each one of the plurality of diamond particles having an acute corner, and wherein a grain diameter of the diamond particles is larger than the predetermined size of the meshes, such that the diamond particles are aligned and embedded into the meshes by the acute corners adhering to the adhesion layer;

infusing a resin material into the molding container to cover the diamond particles, so that the diamond particles are bonded on the resin material; and releasing the resin material having the diamond particles from the molding container such that the resin material and diamond particles are separated from the molding container, adhesion member, and hollow member to form a diamond disc.

2. The diamond disc manufacturing process as claimed in claim 1, wherein the step of forming the adhesion layer comprises placing an adhesion material in the molding container, and rolling the adhesion material to form the adhesion layer.

3. The diamond disc manufacturing process as claimed in claim 2, wherein the adhesion material is a clay materials.

4. The diamond disc manufacturing process as claimed in claim 1, wherein the step of providing the plurality of diamond particles on the hollow member comprises adhering the diamond particles onto an adhesive tape, and sticking the diamond particles onto the hollow member by the adhesive tape, so that the diamond particles are disposed on the hollow member.

5. The diamond disc manufacturing process as claimed in claim 1, wherein a size of the meshes of the hollow member is in a range of 190 μm-220 μm, and a grain diameter of the diamond particles is in a range of mesh 60-mesh 50.

6. The diamond disc manufacturing process as claimed in claim 1, wherein the hollow member is a nylon mesh.

7. The diamond disc manufacturing process as claimed in claim 1, wherein the resin material is an epoxy resin.

8. The diamond disc manufacturing process as claimed in claim 1, wherein the hollow member is pressed into the adhesion layer, such that the adhesion layer fills a portion of the space of the meshes of the hollow member.

* * * * *